US005372210A

United States Patent [19]

Harrell

[11] Patent Number: 5,372,210

[45] Date of Patent: Dec. 13, 1994

[54] ROLLING CUTTER DRILL BITS

[75] Inventor: Patricia N. Harrell, Houston, Tex.

[73] Assignee: Camco International Inc., Houston, Tex.

[21] Appl. No.: 136,442

[22] Filed: Oct. 12, 1993

[30] Foreign Application Priority Data

Oct. 13, 1992 [GB] United Kingdom ..... 9221453

[51] Int. Cl.[5] ..... E21B 10/00

[52] U.S. Cl. ..... 175/431

[58] Field of Search ..... 175/420.1, 426, 428, 175/431, 331, 337, 339, 340

[56] References Cited

U.S. PATENT DOCUMENTS 5,201,376 4/1993 Williams ..... 175/431

5,224,560 7/1993 Fernandez ..... 175/431 X

*Primary Examiner*—Michael Powell Buiz

[57] ABSTRACT

In a rolling cutter drill bit the distribution of the inserts on each rolling cutter is arranged to form a more rounded borehole corner to reduce concentrated side forces and to facilitate directional drilling while minimising gauge wear. Each rolling cutter includes a transition row of inserts which is intermediate the gauge cutting row and bottom cutting row and which drill neither the gauge of the borehole nor the hole bottom, but drill a rounded transition area between the vertical side wall and borehole bottom. The invention provides the ratios between certain key dimensions of the insert rows, such ratios being selected to determine the roundness of the corner of the borehole in such manner as to improve the ability of the bit to drill curved boreholes. These key dimensions include the relative diameters and spacing of the insert rows, the relative diameters of the inserts, and their relative angular orientations with respect to the longitudinal axis of the drill bit.

9 Claims, 6 Drawing Sheets

FIG 3
Prior Art
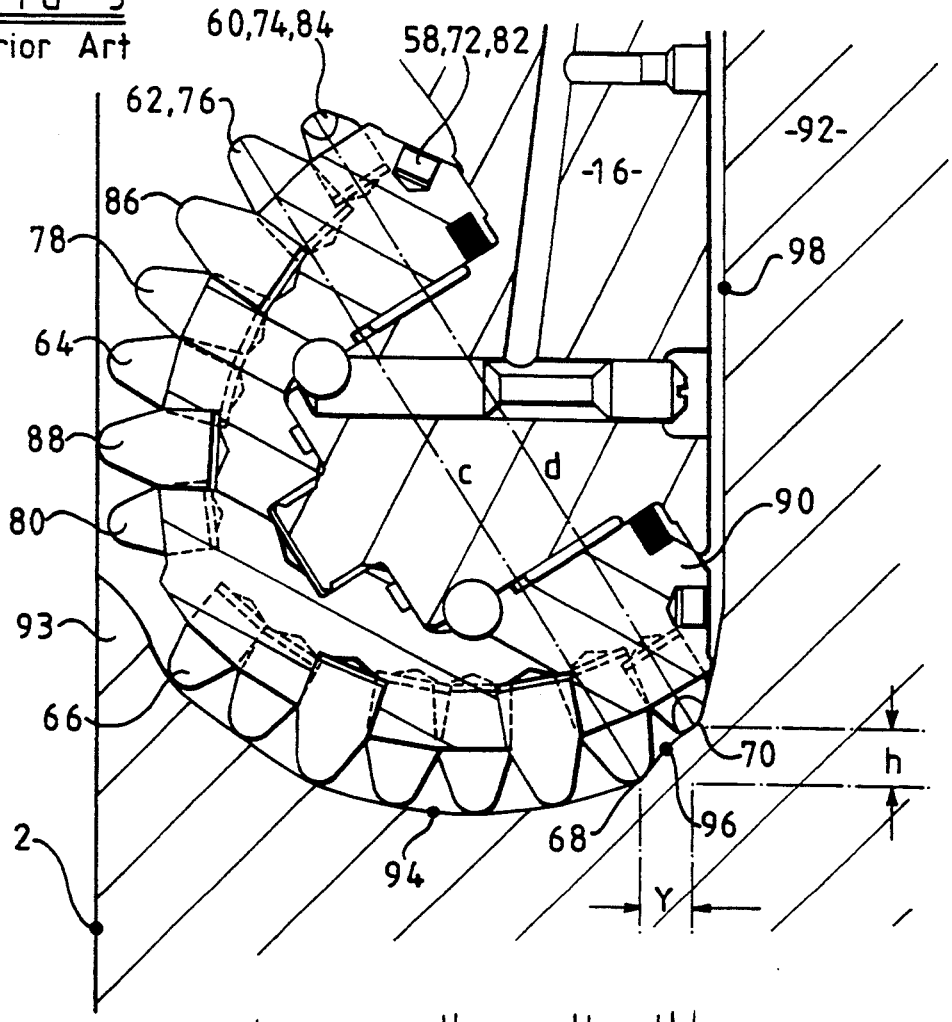
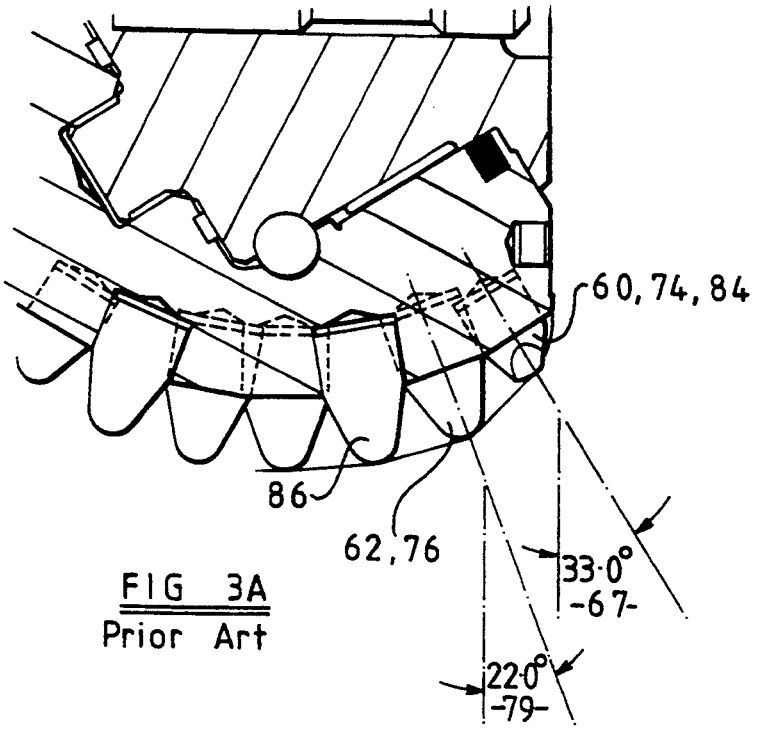
FIG 3A
Prior Art

ROLLING CUTTER DRILL BITS

FIELD OF THE INVENTION

The invention relates to rolling cutter drill bits for drilling holes in subsurface formations and of the kind comprising a body member, three inwardly facing rolling cutters of generally conical configuration rotatably mounted on the body member, a plurality of cutting inserts arranged in generally circumferential rows around the peripheral surface of each rolling cutter cone, and at least one row of cutting elements on each cone intermeshing with a row on an adjacent cone. In particular, the invention is an arrangement of cutting inserts upon rows of a soft formation bit which greatly reduces the insert wear and breakage problems associated with bits used for directional drilling, without sacrificing drilling rate.

BACKGROUND OF THE INVENTION

In the early 1950s the introduction of tungsten carbide cutting elements caused a revolution in rolling cutter drill bits of the above type. Previous bit designs utilised iron or steel rolling cones with cutting elements milled into their surfaces. The life of these milled tooth bits was limited compared to bits with the cutting elements made of sintered tungsten carbide inserts.

Although these inserts greatly improve the drill bit life, their use introduces a new set of design problems. The layout of the cutting elements is more critical, due to the relatively smaller size of the carbide inserts when compared to milled teeth. In addition, the recesses which hold the cutting elements must be arranged so as not to intersect each other below the surface of the rolling cone.

A few very hard formation bit designs feature very dense packing of inserts in cones. The number of inserts which can be employed is limited only by interference of the recesses which hold the cutting inserts. In these bits, the insert row placement upon any one cone is independent of the other two cones, giving the bit designer considerable freedom in row placement. Although this design allows for a very durable cutting structure, the dense packing of inserts and their limited protrusion cause very slow rates of penetration. In this design, the diameters of the rolling cones and the protrusions of the inserts must be sized such that one cutter does not interfere with the adjacent cutters. This design is known as an independently rolling or non-intermeshing bit design. When compared to other three cone drill bit designs, particularly those for drilling soft formations, the reduced cone diameter in a non-intermeshing bit design unacceptably limits bearing size and capacity. Examples of non-intermeshing designs are in U.S. Pat. Nos. 4,056,153, 4,320,808, 4,393,948, and 4,427,081. Non-intermeshed three cone rolling cutter bits are not in common use today.

Most modern three cone insert bits have intermeshed rows of inserts. Although row intermeshing further constrains insert row layout, the bit is still expected to have a long life while maintaining a fast drilling rate. These performance expectations require that the cones be as large as possible within the borehole diameter to provide adequate recess depth for the cutting inserts and the maximum possible bearing size. To achieve maximum cone diameter and still have acceptable insert protrusion, some of the rows of inserts are arranged to protrude into corresponding clearance grooves on adjacent cones. The combined row layout of three intermeshed cutter cones will be sequence of alternating rows from adjacent cones as shown in FIG. 5 of U.S. Pat. No. 4,611,673. The intermesh arrangement allows cutting tips of rows on adjacent cutters to interfit upon bit assembly without interference. Unfortunately, the arrangement limits the conglomerate of the three intermeshing cutters to one operative insert row per track along the borehole in the intermeshed area. Although some rows of inserts near the gauge and at the center of the bit are not intermeshed, the placement of all rows upon the cones is heavily influenced by the placement of the intermeshed rows.

In the drill bit industry there are several different row naming nomenclatures. The nomenclature used herein is similar to that used in U.S. Pat. Nos. 4,611,673 and 4,940,099 and is defined as follows.

Reaming insert rows are located on the portion of the cone closest to the sidewall of the borehole and closely adjacent to the bit body. These inserts act as necessary to ream the already cut full gage diameter of the borehole well above the bottom of the borehole. Reaming rows of inserts are commonly only slightly protruding and non-intermeshing and are of minimal importance in this specification. Reaming insert rows are shown as numeral 32A in U.S Pat. No. 4,940,099.

The row of a cone which first engages the uncut full diameter of the borehole is the gauge row. Most bits have three gauge rows, one row per cone, which redundantly cut gauge at the same area of the formation. The gauge rows are shown as numeral 26 in U.S. Pat. No. 4,611,673. Gauge cutting inserts are located on the cones so as to cut the earth formation adjacent to the hole bottom and often cut a portion of the hole bottom in addition to the gauge. In some bit designs, notably U.S. Pat. No. 3,452,831, several gauge rows of inserts are indicated. Since only the row of a cone which first engages the formation at the gauge of the borehole is the true gauge row, any other rows on the cone which are placed to cut gauge are reaming already cut formation and act as reaming rows.

The intermediate rows of inserts cut the hole bottom. These are the rows on the cones which are most often intermeshed, and are shown as numeral 28 in U.S. Pat. No. 4,611,673.

The nose rows of inserts, shown as numeral 30 in U.S. Pat. No. 4,611,673, are designed to cut near the center of the borehole. These rows can be, but are not always intermeshed.

The rows which cut closer to the center of the borehole than the gauge row (i.e. the intermediate and nose rows) are collectively called the inner rows of the bit.

Drill bits often have a plurality of non-intermeshing rows which redundantly cut along the same track of the formation. As far as the formation is concerned this plurality of rows acts as a single operative row. An operative row is therefore one or more rows of a drill bit which act to cut substantially a single track along the borehole.

By design, each operative insert row is dedicated to cut a specific region of the borehole. The shape (or profile) at the bottom of the borehole is determined by the arrangements of the operative rows of inserts on the bit and the shapes of the cutting inserts. The shape of the borehole has a major influence on the forces imposed on the cutting inserts during drilling and is an important consideration when designing bits for fast penetration and long life. The nomenclature for the various regions of the borehole bottom follows.

At the center of the borehole is the core region. The core is cut by the nose insert rows and is rather easily cut and broken off.

Concentric to the core is the bottom region of the profile. The bottom region is cut by the intermediate rows of the bit. The outer edge of the borehole bottom is cut by the row or rows of inserts on the bit with the greatest cutting diameter with respect to the rotational axis of the cone.

The gage region of the borehole is the cylindrical full diameter surface cut by the gauge and reaming rows of inserts.

The transition region of the borehole is the narrow ring between the outer edge of the borehole bottom and the gauge. An example of a transition region is found in U.S. Pat. No. 2,990,025, FIGS. 2 and 3. The tip of the rows containing the insert indicated as numeral 21 have the greatest radial displacement from the cone's centre of rotation of all other rows of the three cones. This intermediate row, therefore, defines the edge of the hole bottom. The narrow area between this row and the gauge row indicated as numeral 20 is the transition region of the borehole.

In many prior art three cone insert bit designs, and as shown in U.S. Pat. No. 2,774,570 FIG. 1, the rotating cutters have their largest diameter at the gauge insert rows. As a result, both gauge of the borehole and the outermost edge of the hole bottom are drilled by the gauge rows of inserts. This makes the transition of the borehole from the vertical sidewall to the borehole bottom (or corner of the borehole) relatively sharp. A sharp borehole corner, as reported in U.S. Pat. No. 4,231,438, is required so that the bit will maintain a straight drilling path through sloping formations and also helps reduce existing borehole deviation. Even in bit designs utilising different rows for gauge and hole bottom drilling, the corner is still designed to be relatively sharp so that a straight borehole will be drilled. Sharp borehole corners are difficult to cut, however, because of the support lent to the corner by both the borehole wall and the borehole bottom. The insert rows which cut the borehole corner, and particularly the gauge rows, sustain higher forces than any other rows of the bit.

Because of these higher forces, an important design factor for drill bits is the manner in which gauge insert rows are designed. It is important to have as many cutting inserts as possible on the gauge of the bit in order to prolong bit life. For stability of drilling, it is also important that each cone have a gauge row which acts upon the same portion of gauge of the borehole, redundantly. A cone without a gauge row or with a gauge row placed to drill a different portion of the borehole, either closer to or farther from the bottom than the others, will experience different magnitudes and directions of cutting forces. Under certain drilling conditions, this force imbalance can cause the bit's longitudinal axis to orbit about the center of the borehole significantly, a phenomenon called bit gyration. Bit gyration is unacceptable because it causes an uncontrolled hole size to be drilled and it reduces drilling rate.

Modern drill bits must also have row intermeshing to permit high insert protrusions in order to achieve competitive rates of penetration. The constraints of row placement due to intermesh, however, limit the number of operative rows on the bit. Gauge row insert interlocking, as shown in U.S. Pat. No. 2,990,025, has become the accepted manner in which to optimize the row intermeshing of the bit to allow high insert protrusion and still provide an adequate number of cutting inserts for drilling the corner of the borehole. Insert interlocking is the placement of two closely adjacent rows of inserts on the same cone such that each row cuts a different track along the hole bottom, and where the inserts in the rows are alternated to prevent interference between the inserts within the cone. As a consequence, the number of inserts that can be placed on either of the interlocked rows is fewer than the number possible without interlocking. Even though interlocking reduces the number of individual gauge inserts possible on a bit, it facilitates close proximity of adjacent operative rows. Most successful prior art bit designs have three intermeshed cutters with at least one and most often two interlocked gauge rows.

With the advent of modern directional drilling "steerable" drilling systems have become common. Directional drilling has changed the way conventional straight hole drill bits are run and consequently changed the modes of decay of the bits. In particular, accelerated wear and breakage occur on the borehole corner drilling inserts, especially the gauge rows and the closest operative inner row to the gauge. This insert wear and breakage occurs because a bit designed to drill a straight hole experiences higher than normal side forces concentrated upon the gauge and the closest operative inner row to the gauge when forced to drill a curved hole. Because the borehole corner drilling rows have not been designed for directional drilling, sideways acting forces lead to insert breakage. A bit designed to drill a straight hole also places more stress than necessary upon the bit steering mechanism when a curved hole is drilled.

SUMMARY OF THE INVENTION

Accordingly, the present invention provides a new drill bit wherein the distribution of the inserts on each rolling cutter is arranged to form a more rounded borehole corner to reduce concentrated side forces and to facilitate directional drilling while minimising gauge wear. The invention defines a new category of inner row drilling inserts called the transition or transition row inserts which help drill this rounded corner. These inserts drill neither the gauge of the borehole nor the hole bottom. Rather, transition inserts drill the transition area between the vertical side wall and the borehole bottom.

The invention also provides for a novel arrangement of borehole corner cutting rows with each row having inserts of a different diameter than the other rows. This arrangement concentrates inserts in the transition and gauge areas of the borehole and allows a much higher gauge and transition insert packing density per row than previously possible on interlocked, intermeshed bits. Each gauge row cuts at substantially the same portion of the borehole and yet only one gauge row is interlocked. The operative gauge row and the closest operative inner row to the gauge (i.e. the transition row) are also oriented such that the forces generated during directional drilling are aligned more closely along the insert axes.

The present invention is defined, in part, in terms of the ratios between certain key dimensions of a rolling cutter drill bit, such ratios being selected to determine the roundness of the corner of the hole being drilled in such manner as to improve the ability of the bit to drill curved boreholes. The key dimensions of such drill bit, relevant to the present invention, will now be defined.

An insert row cutting diameter is defined by the arc swept by the radially outermost cutting tip of an insert of that row as it revolves around the rotational axis of the cone. The maximum of the diameters of all rows on all of the rolling cone cutters of the drill bit is designated by the letter c, the maximum cutting diameter. This row cuts the outermost edge of the borehole bottom. Similarly, the maximum of the diameters of all rows that cut gauge on all of the rolling cutters of the drill bit is designated by the letter d, the maximum gauge cutting diameter.

The rows of inserts are arranged such that the maximum gauge cutting diameter, d, is significantly smaller than the maximum cutting diameter, c. Additionally, at least one transition row of inserts has an intermediate cutting diameter, t, greater than d and less than c.

With the rolling cutters assembled onto the bit body, a height, h, is measured parallel to the longitudinal axis of the bit body and is the distance from the cutting tip of the gauge row of diameter d to the cutting tip of the bottom drilling row of diameter c. Additionally a distance y is measured perpendicular to the longitudinal axis of the bit between the same aforementioned cutting tips.

In a similar manner h' and y' are the height and distance of the cutting tip of transition row of diameter t from the cutting tip of the gauge row of diameter d.

The ratio h/c characterises the height of the transition area in a dimensionless manner applicable to any bit size. The ratios h/y and h'/y' characterise the slope and curvature of the transition area. The combination of ratios h/c, h/y, and h'/y' provide a description of the roundness of the transition area of the borehole, independent of bit size.

According to one aspect of the invention there is provided a rolling cutter drill bit comprising:

a bit body member;

a plurality of rolling cutters each having a cutter body of generally conical configuration rotatably mounted on the bit body member;

a plurality of cutting elements arranged in generally circumferential rows around each cutter body, each cutting element comprising a cutting insert located in a socket in the cutter body so as to protrude above the cutter body;

the circumferential rows of cutting inserts including at least one bottom cutting row of maximum cutting diameter c, at least one gauge cutting row of gauge cutting diameter d, smaller than diameter c, and at least one transition row of intermediate cutting diameter t, smaller than diameter c and greater than diameter d;

and the bottom cutting, gauge cutting, and transition rows of cutting inserts being arranged such that h'/y' is greater than h/y, the dimensions h, y, h' and y' being as hereinbefore defined.

Preferably h/y is in the range from 1 to 1.5, and h/c is greater than 0.085.

The invention also provides a rolling cutter drill bit comprising:

a bit body member;

a plurality of rolling cutters each having a cutter body of generally conical configuration rotatably mounted on the bit body member;

a plurality of cutting elements arranged in generally circumferential rows around each cutter body, each cutting element comprising a cutting insert located in a socket in the cutter body so as to protrude above the cutter body;

the circumferential rows of cutting elements including at least one gauge cutting row of maximum gauge cutting diameter d and a plurality of operative inner rows each having a cutting diameter;

no more than a single gauge cutting row interlocked with an inner row;

at least one circumferential inner row of cutting inserts intermeshing with a circumferential inner row of cutting inserts on an adjacent rolling cutter;

the gauge cutting row and two adjacent operative inner rows of cutting inserts arranged so that the maximum gauge cutting diameter d is less than the cutting diameters of each of said two adjacent operative inner rows.

The invention further provides a rolling cutter drill bit for drilling boreholes into earthen formations comprising:

a bit body member;

a plurality of rolling cutters each having a cutter body of generally conical configuration rotatably mounted on the bit body member;

a plurality of cutting elements arranged in generally circumferential rows around each cutter body, each cutting element comprising a generally cylindrical cutting insert of fixed diameter located in a socket in the cutter body so as to protrude above the cutter body;

the circumferential rows of cutting elements including a plurality of gauge cutting rows of inserts, one row per rolling cutter, each row orientated to act on the same portion of the earthen formation thereby to act as a single operative row;

the cutting inserts in the gauge cutting row of each rolling cutter being of a different diameter from the cutting inserts in the gauge cutting rows of the other rolling cutters.

The invention further provides a rolling cutter drill bit comprising:

a bit body member having a longitudinal axis;

a plurality of rolling cutters each having a cutter body of generally conical configuration rotatably mounted on the bit body member;

a plurality of cutting elements arranged in generally circumferential rows around each cutter body, each cutting element comprising a cutting insert located in a socket in the cutter body so as to protrude above the cutter body and having an axis extending at a fixed angle with respect to the cutter body;

the circumferential rows of cutting inserts including one gauge cutting row and a plurality of inner rows on each rolling cutter, the gauge rows on the plurality of rolling cutters together forming a single operative gauge row;

at least one of said circumferential inner rows of cutting inserts intermeshing with a circumferential inner row of cutting inserts on an adjacent rolling cutter;

the cutting inserts in said operative gauge row each being orientated at such a fixed angle with respect to its cutter body that its axis is disposed at an angle of between 40° and 70°, and preferably between 50° and 60°, to the longitudinal axis of the drill bit body member when the insert is in a lowermost position relative to the bit body member.

Each of the cutting inserts in the operative inner row closest to said operative gauge row is preferably orientated at such a fixed angle with respect to its cutter body that its axis is disposed at an angle of between 30° and 45°, and more preferably between 35° and 45°, to the longitudinal axis of the drill bit body member when the insert is in a lowermost position relative to the bit body member.

BRIEF DESCRIPTION OF THE DRAWINGS

The following is a more detailed description of embodiments of the invention, reference being made to the accompanying drawings in which:

FIG. 3 schematically depicts a composite layout of the same prior art cutting structure shown in FIG. 2.

FIG. 3A is a similar view of the area of the rolling cutter shown in FIG. 3 adjacent to the borehole bottom and corner.

Table 1 is a listing of h, c, y, h/y, and h/c for a variety of prior art drill bits, and for exemplary drill bits in accordance with the present invention.

DESCRIPTION OF THE PREFERRED EMBODIMENTS

Figure 1:
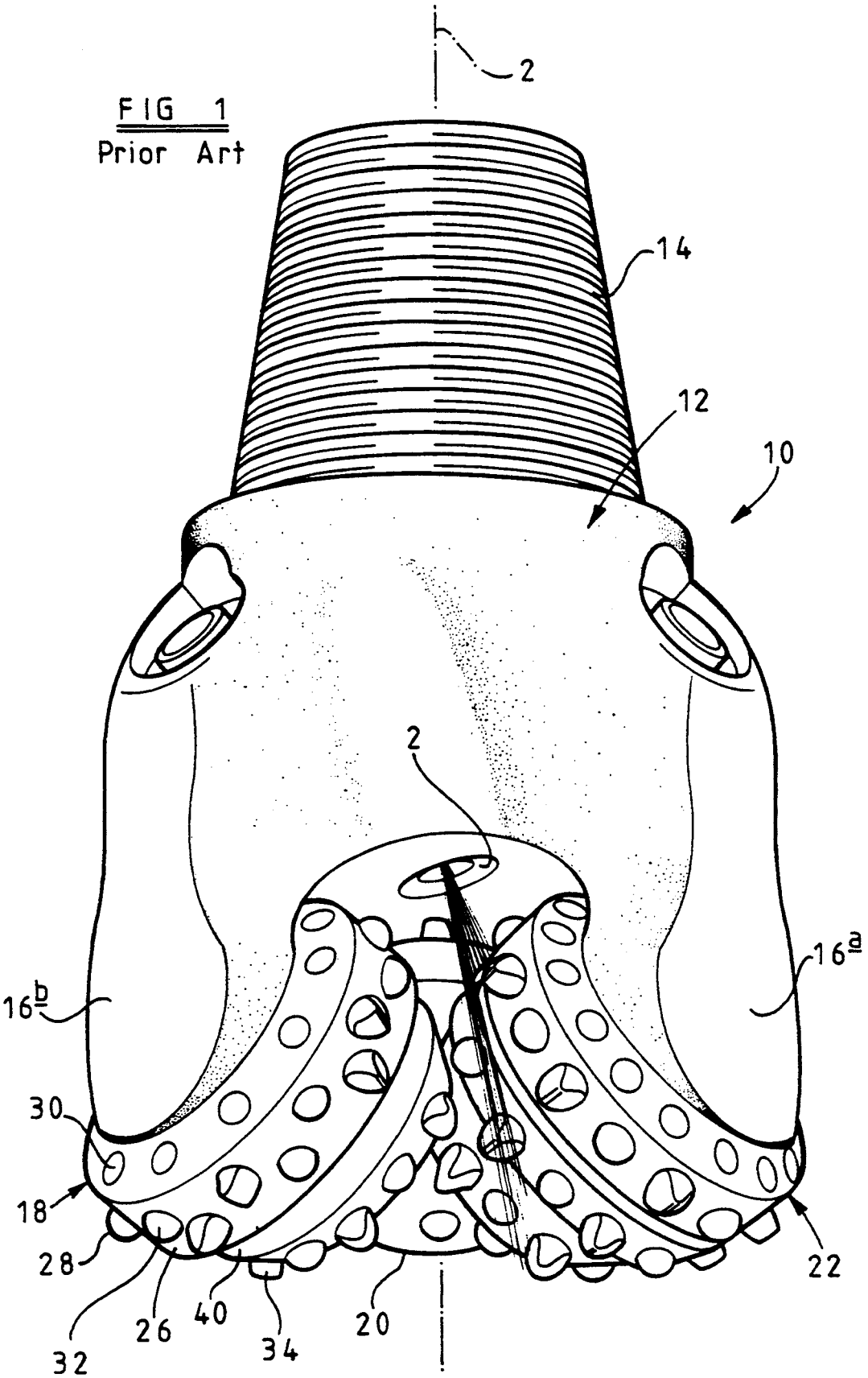
FIG 1 Prior Art
FIG. 1 depicts an exemplary prior art drill bit, illustrated from a side view.

Referring now to the drawings in more detail, and particularly to FIG. 1, therein is depicted a typical prior art three cone drill bit 10. Drill bit 10 includes a body member, indicated generally at 12, and a plurality of downwardly extending lugs **16*a*, 16*b*, and 16*c* (not visible) which will support each of the rolling cutters, 18, 20 and 22**.

A typical rolling cone cutter 18 includes a conical body 26 which supports a plurality of cutting inserts, indicated generally at 28. Cutting inserts 28 will preferably be formed of a hardened material such as tungsten carbide adapted to cut an earthen formation. Rolling cone 18 includes inserts 28 arranged in a plurality of rows, indicated generally at 30, 32, and 34. Reaming row 30 includes inserts designed to ream the outermost dimension, or the "gauge", of the borehole after this gauge has been cut by the gauge inserts of row 32. Between some rows, for example, between rows 32 and 34, rolling cone 18 includes a peripheral groove 40 to prevent interference and allow intermesh between rolling cone 18 and adjacent rolling cones 20 and 22.

Figure 2:
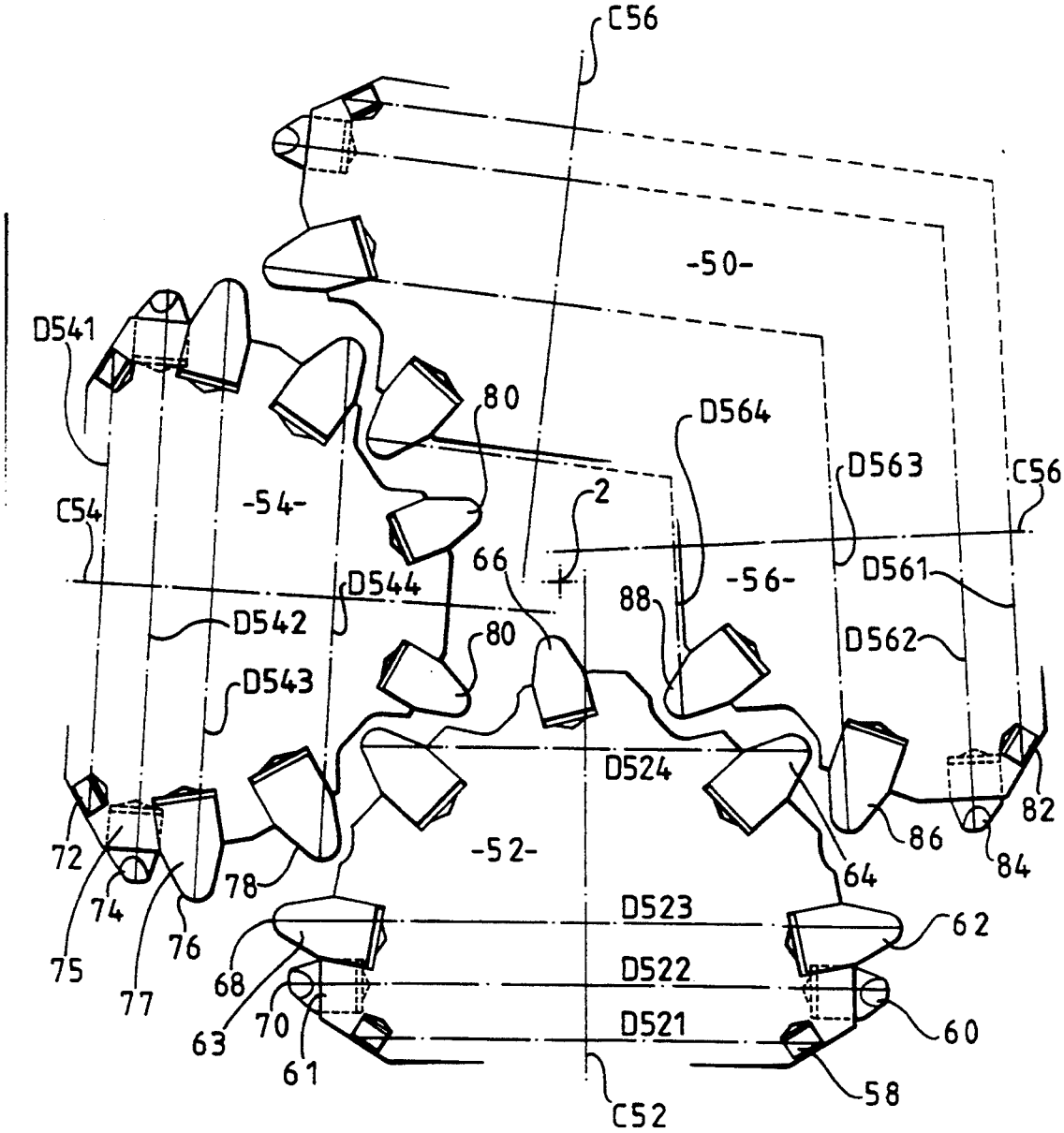
FIG 2 Prior Art
FIG. 2 is an assembly view, showing the intermeshing of the cutting structure on one exemplary prior art bit design.

Referring now to FIG. 2, therein is an assembly view of the structure of one exemplary prior art bit of conventional design. The bit shown is a 12¼" HP51 manufactured by Reed Tool Co., Houston, Tex. As will be familiar to those skilled in the art, the schematic depiction of rolling cone 56 is separated from the rolling cones 52 and 54 to most accurately depict the clearances relative to rolling cones 52 and 54 and the longitudinal axis of the bit 2.

Rolling cone cutter 52 has five rows of cutting inserts, indicated at 58, 60, 62, 64 and 66. The rotational axis of the cone is shown as C52. The reaming row 58 has a diameter shown as D521. The gauge row 60 has a diameter D522. The intermediate row 62 has diameter D523 and so on.

Rolling cutters 54 and 56 have rows and diameters indicated in a manner similar to cutter 52. For the prior art drill bit shown in FIG. 2, a 12¼" HP51 model made by Reed Tool Company, the diameters are as follows:

| Cutter 52 | Cutter 54 | Cutter 56 |
|---|---|---|
| D521 5.472" | D541 5.472" | D561 5.472" |
| D522 6.944" | D542 6.944" | D562 6.944" |
| D523 7.296" | D543 7.296" | D563 6.850" |
| D524 5.220" | D544 6.148" | D564 4.023" |

As shown in the above table, the maximum diameter of a gauge row is 6.944" on D522, D542 and D562. The maximum of all the diameters of the rows on the bit is 7.296" on D523 and D543. For this particular design, the aforementioned maximum cutting diameter c is 7.296" and the aforementioned maximum gauge cutting diameter d is 6.944".

The overlap of the inserts 61 and 63 of gauge row 60 and. intermediate row 62 of cone 52 indicates gauge row interlocking. Another cone with gauge row interlocking is cone 54, as shown by the overlap of inserts 75 and 77.

Referring now to FIG. 3, herein schematically depicts a composite layout of the same 12¼" HP51 drill bit as shown in FIG. 2. The form of the layout shows all rows projected onto one cone generally shown as 90, and acting upon half of the profile of the borehole directly beneath the cone centerline. The regions of the borehole cut into the earth 92 by this bit are indicated by 93, 94, 96 and 98. The maximum gauge cutting diameter d and the maximum cutting diameter c are both indicated as well as the longitudinal axis 2 of the bit. The rows of inserts are arranged such that the borehole formed thereby can be defined by a core region 93, a bottom region 94, a vertical sidewall region 98 and a transition region 96 between bottom and sidewall. There are no rows of inserts lying wholly within the transition region 96 which is the portion of the borehole lying between the cutting tips on the maximum gauge cutting diameter rows 60, 74, and 84 and the maximum cutting diameter rows 62 and 76. A height h is indicated parallel to the longitudinal axis 2 of the bit body and is the distance from the cutting tip 70 of the gauge row of diameter d to the cutting tip 68 of the bottom drilling row of diameter c. Additionally a distance y is measured perpendicular to the longitudinal axis of the bit between the same cutting tips 68 and 70. Distance h is the height of the transition region 96 between the hole bottom 94 and the vertical sidewall 98. For this particular 12¼" bit design h=0.542". The relative height of this transition region applicable to any bit size is expressed as a ratio h/c. Distance y is the width of the transition region. The slope of the transition region is expressed by the ratio h/y. The two ratios combined determine the general abruptness of the transition. Therefore for this particular prior art bit, a 12¼" HP51, the ratio h/c=0.542/7.296 or 0.074, and h/y=0.542/0.511 or 1.06.

As shown in FIG. 3, the three gauge rows 60, 74 and 84 are exactly overlaying each other. To the formation, these three rows act as a single row. Therefore on this bit the three gauge rows 60, 74, and 84 are collectively called the operative gauge row. In a similar manner, the intermediate rows 62 and 76 overlay each other exactly. These rows are an operative intermediate row.

Referring now to FIG. 3A, herein is a similar view of the edge of the borehole of the same bit shown in FIG. 3. The angular orientation 67 of the insert axis of the gauge rows 60, 74, and 84 with respect to the borehole wall is about 33 degrees. Similarly, the axis angle 79 of the inserts on the closest operative inner row to the gauge, rows 62 and 76, is about 22 degrees. Because the inserts are strong in compression and relatively weak in tension, these insert rows on the bit are aligned in generally the same direction as the action of the drilling forces. Therefore, for normal straight hole drilling, the 33 degree insert axis angle 67 and the 22 degree angle 79 are generally aligned with the average resultant forces from the corner of the borehole applied to the inserts of these rows. During directional drilling, however, the loading upon the inserts of these rows is quite different. The severe asymmetric insert wear observed on bits used for direction drilling indicates that there are high side forces acting upon the gauge rows and the closest operative inner row to the gauge. Insert wear and breakage on these rows is therefore often severe when these prior art bits are used for directional drilling. Since the bits must be able to drill vertically as well as directionally, if one were to increase the insert orientation angles to make a bit more suitable for directional drilling, gauge insert breakage would become excessive during vertical drilling. As a consequence, the angles remain unchanged and the directional driller often sacrifices drilling rate to prolong bit life by reducing the weight or the rpm of the bit.

TABLE 1

COMPARISON TO PRIOR ART

| Reed Tool Co. Size & Type | | h | c | Y | h/c | h/y |
|---|---|---|---|---|---|---|
| PRIOR ART | | | | | | |
| 7⅞" | HP43AM | .291 | 4.768 | .426 | .061 | 0.627 |
| 8½" | HP51 | .375 | 5.036 | .506 | .074 | 0.741 |
| 8¾" | HP51 | .319 | 5.178 | .377 | .062 | 0.846 |
| 12¼" | HP51 | .542 | 7.296 | .511 | .074 | 1.060 |
| 16" | HP44A | .598 | 9.616 | .598 | .031 | 1.000 |
| 17½" | HP51A | .532 | 10.236 | .664 | .052 | 0.801 |
| PRESENT INVENTION | | | | | | |
| 7⅞" | NEW | .639 | 4.676 | .557 | .136 | 1.147 |
| 12¼" | NEW | .840 | 7.339 | .737 | .114 | 1.139 |

Referring now to Table 1 therein is a listing of exemplary prior art bits manufactured by Reed Tool Co. with the values of h, c, and y, and the ratios h/c, and h/y. The prior art bits listed in the table are typical for bits which drill more rounded borehole corners than the average commercially available bit. As can be seen, none of these bits has a ratio h/c of greater than 0.074 combined with a ratio h/y of between 1. and 1.5.

Figure 4:
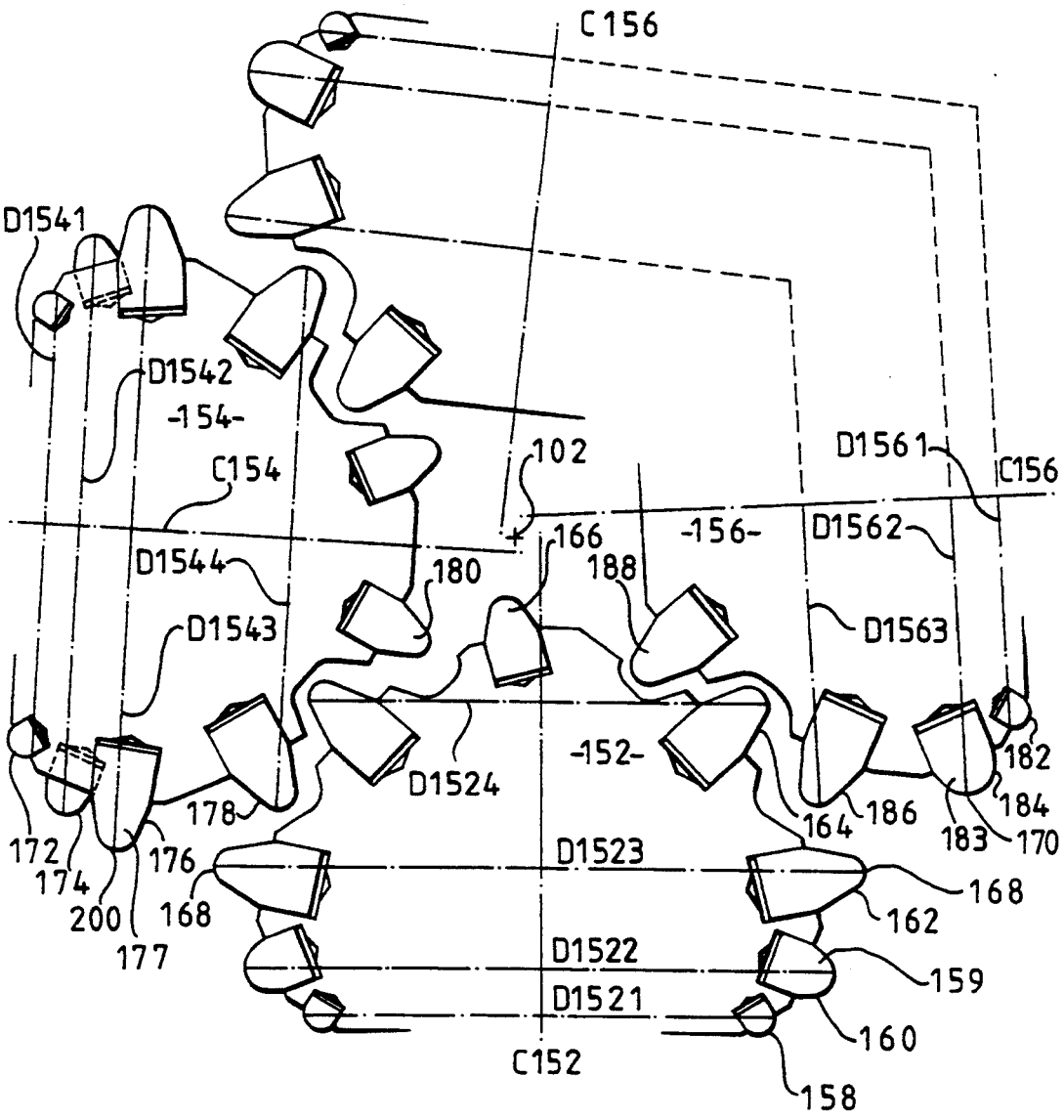
FIG. 4 is an assembly view of a cutting structure for a bit in accordance with the present invention.

Referring now to FIG. 4, therein is schematically depicted a cutting structure for a bit in accordance with the present invention. Elements in FIGS. 4, 5, and 5A corresponding to elements in FIGS. 2, 3 and 3A have corresponding reference numbers, but increased by 100. The bit according to the invention thus includes three rolling cone cutters 152, 154, and 156. Again, the schematic depiction of rolling cutter 156 is separated from the rolling cutters 152 and 154 to most accurately depict the clearances relative to rolling cones 152 and 154 and the longitudinal axis of the bit 102.

Cone 152 has four rows of inserts, indicated at 158, 160, 162 and 164. Cone 152 also includes a nose insert 166. The rotational axis of the cone is shown as C152. Row diameters are defined in the same manner previously described.

For the drill bit of the present invention bit shown in FIG. 4, the diameters are as follows:

| Cutter 152 | Cutter 154 | Cutter 156 |
|---|---|---|
| D1521 5.283" | D1541 5.283" | D1561 5.283" |
| D1522 6.627" | D1542 6.585" | D1562 6.733" |
| D1523 7.339" | D1543 7.326" | D1563 6.889" |
| D1524 5.165" | D1544 6.195" | |

As shown in the above table, the maximum diameter of a gauge row is 6.733" on D1562. Although each gauge row has a different cutting diameter, each row cuts the same track along the gauge of the borehole. The gauge rows 174, 160 and 184 are redundant on the gauge and are therefore a single operative gauge row. The maximum of all the diameters of the rows on the bit is 7.339" on D1523. For this particular design, therefore, the maximum cutting diameter c is 7.339". The maximum gauge cutting diameter d is 6.733".

Figure 5:
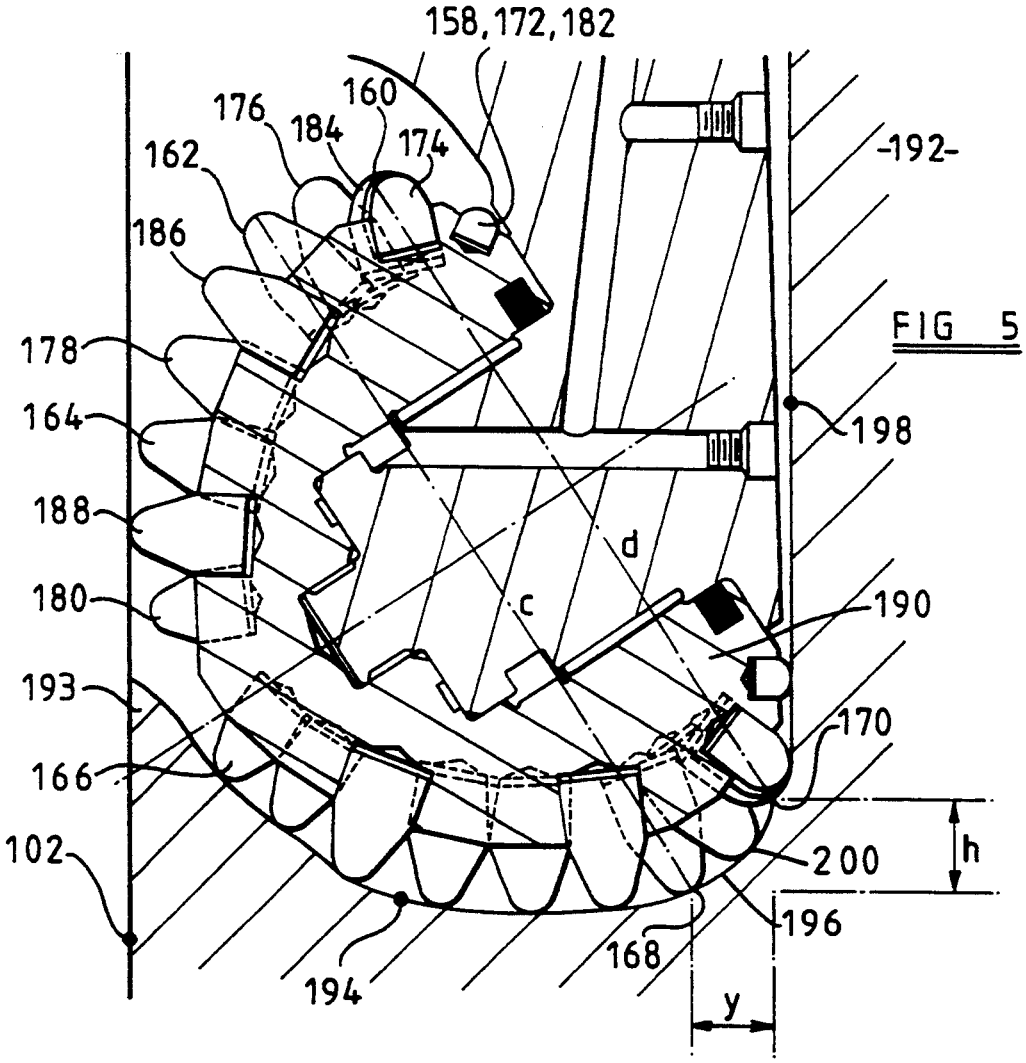
FIG. 5 schematically depicts a composite layout for a bit in accordance with the present invention with the same cutting structure shown in FIG. 4.

The overlap of the inserts 175 and 177 of gauge row 174 and transition row 176 of cone 154 indicates gauge row interlocking. Gauge row 174 is fitted with cutting inserts of a smaller diameter than the cutting inserts of gauge rows 160 and 184. This allows a greater count of inserts to be placed upon the gauge row 174. In order to achieve bit stability, the row is aligned with the other gauge rows 160 and 184 to cut at the same track of the borehole as shown in FIG. 5. Gauge row 160 on cone 152 has inserts 159 with an intermediate diameter, larger in diameter than the cutting inserts 175 in gauge row 174 and smaller in diameter than the cutting inserts 183 in gauge row 184. Thus, the cutting inserts in the gauge cutting row of each rolling cutter are of a different diameter from the cutting inserts in the gauge cutting rows of the other rolling cutters. The insert diameter on row 160 is designed so that there is no need for interlocking with the adjacent row 162. Gauge row 184 is also not interlocked. The combination of three different cutting insert diameters on the gauge rows of this bit design allow the bit to have maximum insert packing on the three gauge rows. The result is less gauge insert wear and greater gauge insert durability than the prior art gauge row designs.

Referring now to FIG. 5, therein is schematically depicted a composite layout of the same bit designed in accordance with the present invention as shown in FIG. 4. The form is similar to that shown in FIG. 3. The borehole cut into the earth 192 by this bit indicated by 193, 194, 196 and 198. The rows of inserts indicated by 158, 172, 182, 174, 160, 184, 176, 162, 186, 178, 164, 188, 180 and 166 correspond to those indicated in FIG. 4. The operative reaming row is comprised of individual rows 158, 172 and 182 and the operative gauge row is comprised of rows 174, 160 and 184. The maximum gauge cutting diameter d and the maximum cutting diameter c are also both indicated as well as the longitudinal axis 102 of the bit. The rows of inserts are arranged such that the borehole formed thereby can be defined by a core region 193, a bottom region 194, a vertical sidewall region 198 and a transition region 196 between bottom and sidewall.

The transition region of the borehole 168 is between the radially outermost cutting tips on the maximum gauge cutting diameter row(s) and the maximum cutting diameter row(s) as indicated by 170 and 168 respectively. At least one row of transition inserts 176 has a cutting tip 200 which lies within this transition region. For this particular bit design h=0.840" and y=0.737". Therefore, the relative height ratio is calculated, h/c=0.840/7.339 or 0.114 and the slope ratio h/y=0.840/0.737 or 1.139. Note that h/y has to be approximately equal to 1 for this transition region to be centered in the borehole corner. In the course of developing the drill bit of the present invention, it was found that a ratio h/y significantly less than 1 would not allow an effective rounding of the borehole corner and consequently caused overloading and fracture of the gauge row inserts. Additionally, when h/y became greater than 1.5 the roundness of the borehole corner again was ineffective, overloading and fracturing the transition row inserts. To achieve balanced loading between the gauge and transition rows in directional drilling, the ratio h/y should be between 1 and 1.5.

In the preferred embodiment, at least one row of inserts 176 is dedicated to cutting only the transition region 196 of the borehole, as it cuts neither the gauge portion 198 of the borehole nor the bottom portion 194 of the borehole.

Figure 5A:
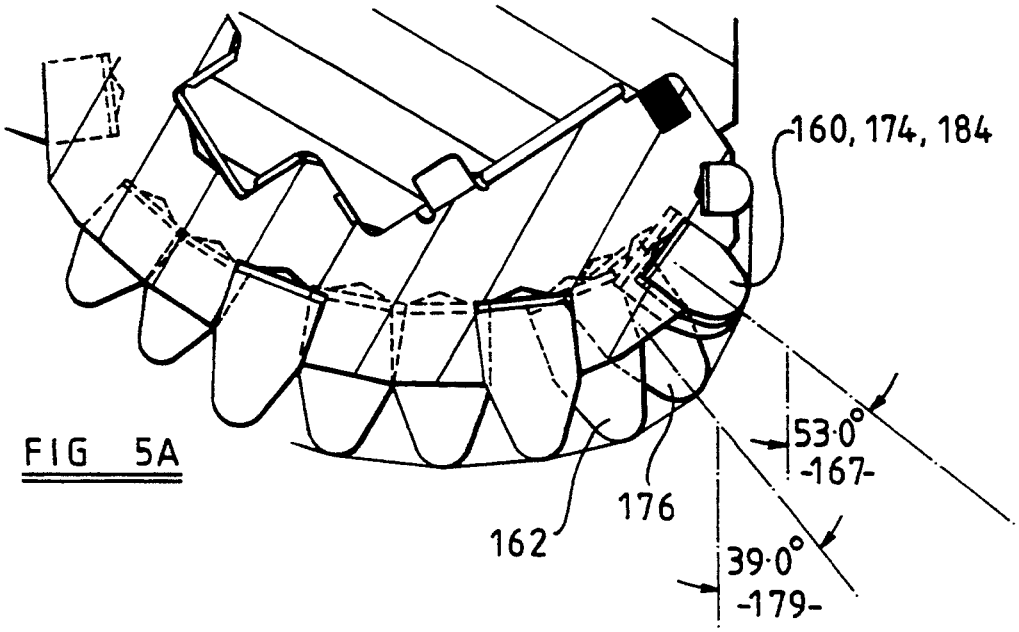
FIG. 5A is a similar view of the area of the rolling cutter shown in FIG. 5 adjacent to the borehole bottom and corner.

FIG. 5A is an enlargement of the area of the rolling cone adjacent the borehole corner and bottom, shown in FIG. 5. During directional drilling there are significant side forces on the operative gauge row 160, 174, and 184 and the operative inner row 176 closest to the gauge. Each cutting insert is located in a socket in its rolling cutter body so as to protrude above the cutter body with its axis extending at a fixed angle with respect to the cutter body. When each insert is in its lowermost position, i.e. is closest to the bottom of the borehole, the axis of the insert extends at a predetermined angle to the longitudinal axis 102 of the drill bit. Where the sidewall of the borehole is generally parallel to the longitudinal axis of the bit, the insert will extend at a similar angle to the sidewall.

As shown in FIG. 5A, the cutting inserts in the operative gauge row 160, 174, 184 are orientated to extend at an angle 167 to the longitudinal axis of the drill bit, when in the lowermost position relative to the drill bit, while the inserts in the operative inner row 176 closest to the gauge extend at an angle 179 to the longitudinal axis. For each of these operative rows there is a minimum value of the insert orientation angle 167 and 179 which effectively alleviates insert fracture by reducing the degree of misalignment between insert axes and applied directional drilling loads. When inserts are orientated below these minimum angular values, insert breakage becomes excessive.

If a directional bit with inserts orientated as indicated above is run in non-directional drilling, the forces applied to these same rows of inserts become significantly off axis. However, compared to the high forces present in prior art bits due to the sharp formation corner, the forces generated drilling the rounded corner by the bit of the present invention are substantially reduced. At some angle, however, even the reduced forces present will lead to excessive insert breakage. Therefore, for the gauge row inserts 160, 174 and 184 and the adjacent inner row inserts 176 of the present invention the maximum values of the insert orientation angles 167 and 179 are limited. Exceeding these maximum angular values will again lead to insert breakage.

For the preferred embodiment, the angle 167 between the axis of the gauge inserts and the sidewall of the formation is between 40 and 70 degrees, and preferably between 50 and 60 degrees. The corresponding angle 179 for the inserts of the closest operative inner row to the gauge 176 for the preferred embodiment is between 30 and 45 degrees, and preferably between 35 and 45 degrees.

Figure 6:
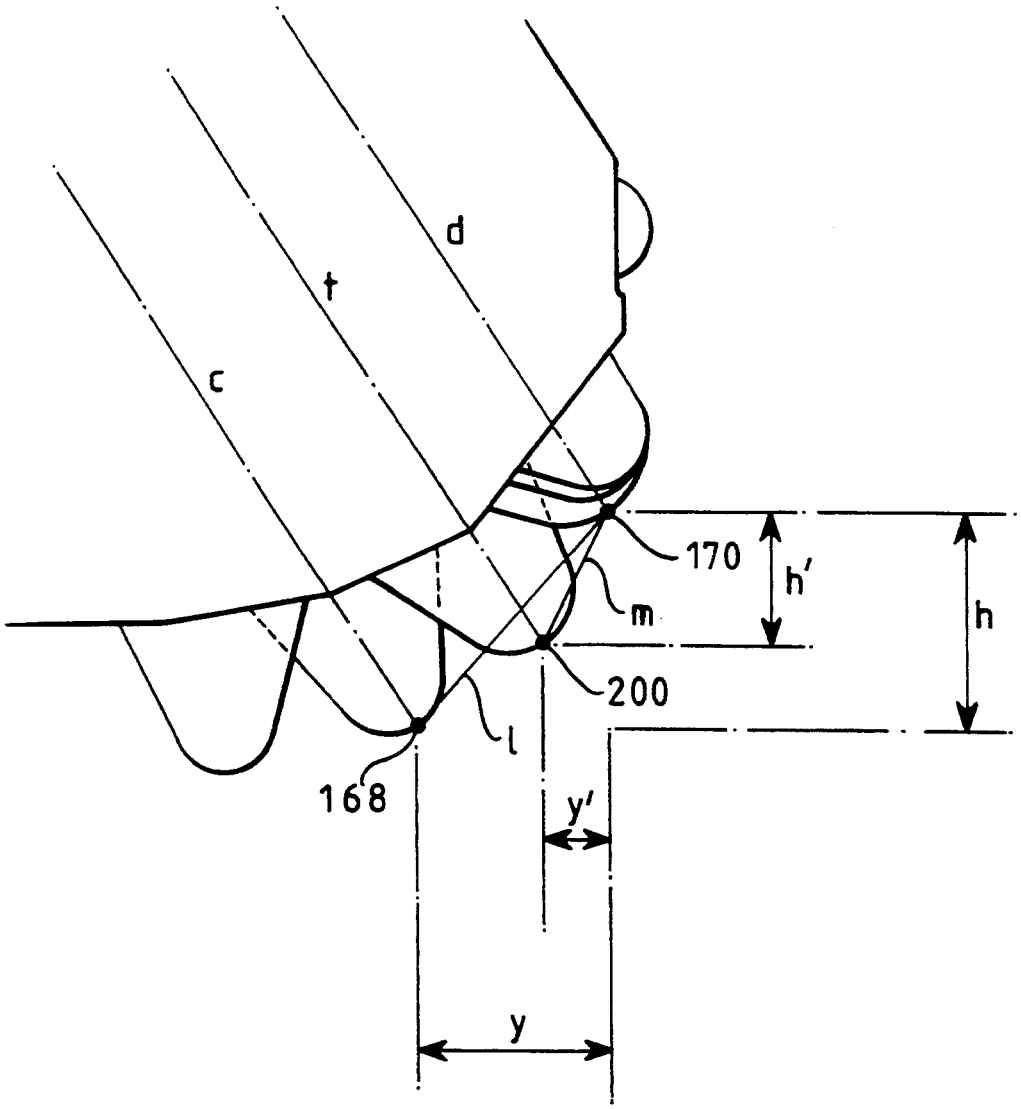
FIG. 6 is an enlargement of the area of the rolling cutter adjacent the borehole corner shown in FIG. 5.

FIG. 6 is an enlargement of the area of the rolling cone adjacent the borehole corner shown in FIG. 5. The height h and the distance y between the largest gauge cutting diameter d tip 170 and the largest cutting diameter c tip 168 are shown. A line 1 is indicated joining points 168 and 170. The slope of line 1 is h/y. Additionally, a height h' and the distance y' between the largest gauge cutting diameter d tip 170 and the transition row cutting diameter t tip 200 are shown. A line m is indicated joining points 170 and 2000. The slope of line m is h'/y'. If point 200 were to lie on line 1 then h'/y' would be equal to h/y. However, for the proper rounding of the borehole corner, the transition row cutting diameter t would have to be increased so that point 200 would not lie on line 1. When this is done the slope h'/y' is greater than the slope h/y. For example, for this particular bit design h/y =0.840/0.737, or 1.139, and h'/y'=0.516/0.251, or 2.055.

One consequence of this geometry is that the maximum gauge cutting diameter D1562 will be smaller than the cutting diameters of the next two inner operative rows 176 and 162 of the bit. In order to provide the cutting diameters c and t as defined above, the maximum gauge cutting diameter d must be smaller than both. Less obvious is the fact that this relationship is novel in three cone bits with intermeshed teeth with only one interlocked gauge row. This novel relationship is due to the manner in which the rows must be arranged (as previously described) to simultaneously: a) intermesh for high drilling penetration rates, b) cut the rounded borehole corner to reduce gauge loading and enhance steerability, and, c) attain maximum gauge insert packing densities possible with minimal interlocking to reduce gauge insert wear.

Many modifications and variations may be made in the techniques and structures described and illustrated herein without departing from the scope and the present invention. For example, non-rotating cutting elements of natural or synthetic diamond or other durable material could be arranged upon the bit body to cut the gauge of the borehole higher in the hole than the rolling cutters. Although this would represent the true gauge of the hole, the function and behaviour of the rolling cutters would remain unchanged. Additionally, although three cone bit designs have been specifically illustrated, other multi-cone designs may be similarly constructed in accordance with the present invention. Accordingly, it should be readily understood that the embodiments described and illustrated herein are illustrative only and are not to be considered as limitations upon the scope of the present invention.

I claim:

1. A rolling cutter drill bit comprising:

a bit body member having a longitudinal axis;

a plurality of rolling cutters each having a cutter body of generally conical configuration rotatably mounted on the bit body member;

a plurality of cutting elements arranged in generally circumferential rows around each cutter body, each cutting element comprising a cutting insert located in a socket in the cutter body so as to protrude above the cutter body;

the circumferential rows of cutting inserts including at least one bottom cutting row of maximum cutting diameter c, at least one gauge cutting row of gauge cutting diameter d, smaller than diameter c, and at least one transition row of intermediate cutting diameter t, smaller than diameter c and greater than diameter d, each said row of cutting inserts having a respective cutting tip;

and the bottom cutting, gauge cutting, and transition rows of cutting inserts being arranged such that $h'/y'$ is greater than $h/y$, wherein:

h is the distance from the cutting tip of the gauge row of diameter d to the cutting tip of the bottom cutting row of diameter c, measured parallel to said longitudinal axis of the bit body member, y is the distance from the cutting tip of the gauge row of diameter d to the cutting tip of the bottom cutting row of diameter c, measured perpendicular to said longitudinal axis, h' is the distance from the cutting tip of the transition row of diameter t to the cutting tip of the gauge row of diameter d, measured parallel to said longitudinal axis, and y' is the distance from the cutting tip of the transition row of diameter t to the cutting tip of the gauge row of diameter d, measured perpendicular to said longitudinal axis.

2. A rolling cutter drill bit according to claim 1, wherein h/y is in the range from 1 to 1.5.

3. A rolling cutter drill bit according to claim 1, wherein h/c is greater than 0.085.

4. A rolling cutter drill bit comprising:

a bit body member;

a plurality of rolling cutters each having a cutter body of generally conical configuration rotatably mounted on the bit body member;

a plurality of cutting elements arranged in generally circumferential rows around each cutter body, each cutting element comprising a cutting insert located in a socket in the cutter body so as to protrude above the cutter body;

the circumferential rows of cutting elements including at least one gauge cutting row of maximum gauge cutting diameter d and a plurality of operative inner rows each having a cutting diameter;

no more than a single gauge cutting row interlocked with an inner row;

at least one circumferential inner row of cutting inserts intermeshing with a circumferential inner row of cutting inserts on an adjacent rolling cutter;

the gauge cutting row and two adjacent operative inner rows of cutting inserts arranged so that the maximum gauge cutting diameter d is less than the cutting diameters of each of said two adjacent operative inner rows.

5. A rolling cutter drill bit for drilling boreholes into earthen formations comprising:

a bit body member;

a plurality of rolling cutters each having a cutter body of generally conical configuration rotatably mounted on the bit body member;

a plurality of cutting elements arranged in generally circumferential rows around each cutter body, each cutting element comprising a generally cylindrical cutting insert of fixed diameter located in a socket in the cutter body so as to protrude above the cutter body;

the circumferential rows of cutting elements including a plurality of gauge cutting rows of inserts, one row per rolling cutter, each row orientated to act on the same portion of the earthen formation thereby to act as a single operative row;

the cutting inserts in the gauge cutting row of each rolling cutter being of a different diameter from the cutting inserts in the gauge cutting rows the other rolling cutters.

6. A rolling cutter drill bit comprising:

a bit body member having a longitudinal axis;

a plurality of rolling cutters each having a cutter body of generally conical configuration rotatably mounted on the bit body member;

a plurality of cutting elements arranged in generally circumferential rows around each cutter body, each cutting element comprising a cutting insert located in a socket in the cutter body so as to protrude above the cutter body and having an axis extending at a fixed angle with respect to the cutter body;

the circumferential rows of cutting inserts including one gauge cutting row and a plurality of inner rows on each rolling cutter, the gauge rows on the plurality of rolling cutters together forming a single operative gauge row;

at least one of said circumferential inner rows of cutting inserts intermeshing with a circumferential inner row of cutting inserts on an adjacent rolling cutter;

the cutting inserts in said operative gauge row each being orientated at such a fixed angle with respect to its cutter body that its axis is disposed at an angle of between 40° and 70° to the longitudinal axis of the drill bit body member when the insert is in a lowermost position relative to the bit body member.

7. A rolling cutter drill bit according to claim 6, wherein each of the cutting inserts in said operative gauge row is orientated at such a fixed angle with respect to its cutter body that its axis is disposed at an angle of between 50° and 60° to the longitudinal axis of the drill bit body member when the insert is in a lowermost position relative to the bit body member.

8. A rolling cutter drill bit comprising:

a bit body member having a longitudinal axis;

a plurality of rolling cutters each having a cutter body of generally conical configuration rotatably mounted on the bit body member;

a plurality of cutting elements arranged in generally circumferential rows around each cutter body, each cutting element comprising a cutting insert located in a socket in the cutter body so as to protrude above the cutter body and having an axis extending at a fixed angle with respect to the cutter body;

the circumferential rows of cutting inserts including one gauge cutting row and a plurality of inner rows on each rolling cutter, the gauge rows on the plurality of rolling cutters together forming a single operative gauge row;

at least one of said circumferential inner rows of cutting inserts intermeshing with a circumferential inner row of cutting inserts on an adjacent rolling cutter;

the cutting inserts in the operative inner row closest to said operative gauge row each being orientated at such a fixed angle with respect to its cutter body that its axis is disposed at an angle of between 30° and 45° to the longitudinal axis of the drill bit body member when the insert is in a lowermost position relative to the bit body member.

9. A rolling cutter drill bit according claim 8, wherein each of the cutting inserts in said closest operative inner row is orientated at such a fixed angle with respect to its cutter body that is axis is disposed at an angle of between 35° and 45° the longitudinal axis of the drill bit body member when the insert is in a lowermost position relative to the bit body member.

* * * * *